United States Patent [19]

McGeer

[11] Patent Number: 4,592,820

[45] Date of Patent: Jun. 3, 1986

[54] ELECTROLYTIC REDUCTION CELLS FOR ALUMINIUM PRODUCTION

[75] Inventor: James P. McGeer, Kingston, Canada

[73] Assignee: Alcan International Limited, Montreal, Canada

[21] Appl. No.: 775,735

[22] Filed: Sep. 12, 1985

Related U.S. Application Data

[63] Continuation of Ser. No. 680,906, Dec. 12, 1984, abandoned, which is a continuation of Ser. No. 497,726, May 24, 1983, abandoned.

[30] Foreign Application Priority Data

May 28, 1982 [GB] United Kingdom ..... 8215728

[51] Int. Cl.[4] ..... C25C 3/08; C25B 11/12

[52] U.S. Cl. ..... 204/243 R; 204/290 R; 204/294; 204/274

[58] Field of Search ..... 204/243 R, 243 M, 244–247, 204/67, 290 R, 274

[56] References Cited

U.S. PATENT DOCUMENTS

| | | | |
|---|---|---|---|
| 3,093,570 | 6/1963 | Dewey | 204/243 R |
| 3,256,173 | 6/1966 | Schmitt et al. | 204/243 R |
| 3,779,699 | 12/1973 | Russell et al. | 204/243 R |
| 3,856,650 | 12/1974 | Kugler et al. | 204/243 R |
| 4,071,420 | 1/1978 | Foster et al. | 204/67 |
| 4,194,959 | 3/1980 | Hudson et al. | 204/243 R |
| 4,224,128 | 9/1980 | Walton | 204/243 R |
| 4,396,482 | 2/1983 | Das et al. | 204/243 R |
| 4,405,433 | 9/1983 | Payne | 204/243 R X |

*Primary Examiner*—Donald R. Valentine

*Attorney, Agent, or Firm*—Cooper, Dunham, Clark, Griffin & Moran

[57] ABSTRACT

In conventional electrolytic cells for aluminium production, heat loss through the side walls is necessary to cause the formation of a protective layer of solid electrolyte. In this invention, the side walls are lined with a ceramic material, e.g. titanium diboride, resistant to the electrolyte and to molten aluminium. Thermal insulation is provided such that a layer of solid electrolyte is not present during normal operation of the cell. A cathode current collection system is provided such that the horizontal lateral currents in the cathode are insignificant compared with the vertical current.

7 Claims, 1 Drawing Figure

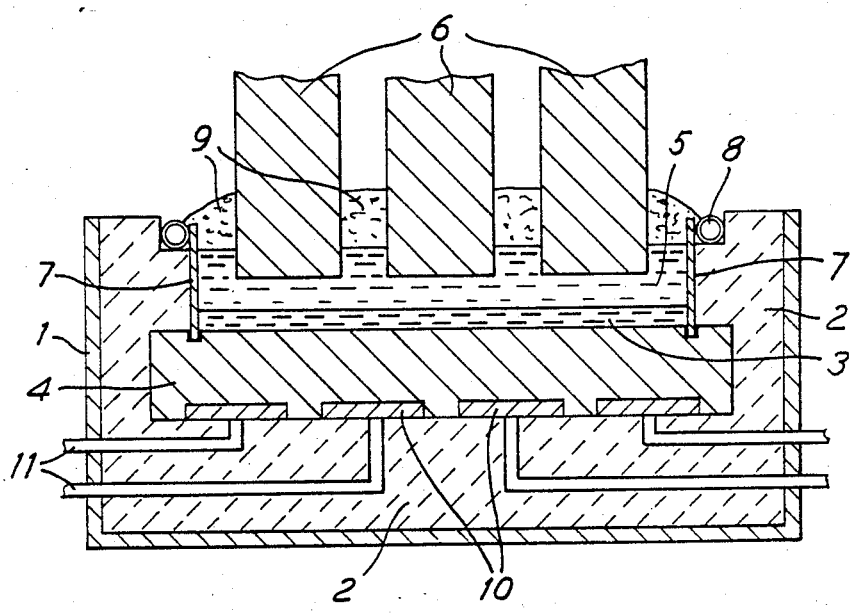
6
9
5
8
7
7
1
2
3
4
11
2
10

ELECTROLYTIC REDUCTION CELLS FOR ALUMINIUM PRODUCTION

This is a continuation of application Ser. No. 06/680,906, filed Dec. 12, 1984, now abandoned which is a continuation of application Ser. No. 06/497,726, filed May 24, 1983 (now abandoned).

The present invention relates to electrolytic reduction cells and in particular to electrolytic reduction cells for the production of aluminium by the reduction of alumina in a molten fluoride salt bath.

In conventional electrolytic cells the electrolyte is contained in a cell, lined with carbon blocks. The floor of the cell is covered by a layer of molten aluminium metal, which constitutes the cathode of the cell, and the cathode current is conducted downward through the floor of the cell to collector bars embedded in the carbon floor blocks and connected to bus bars, which normally extend lengthwise on opposite sides of the cell.

Since the molten electrolyte tends to attack the carbon lining material, in conventional practice a layer of solid electrolyte is maintained against the cell side wall. This involves the relatively rapid escape of heat through the thermal insulation layer which backs the cell side wall. The solidified electrolyte is relatively non-conductive and so insulates the side walls of the cell from the cell currents.

In a conventional electrolytic cell the bottom and sometimes the side walls of the cell are thermally insulated. The cell bottom is usually so heavily insulated that the heat loss through the bottom is probably as small as 5% of the total heat loss from the cell and consequently there is little possibility of further reduction of the heat loss in that direction.

The largest proportion of the heat loss from the cell is in the upward direction. Large parts of such losses are in the thermal content of the large volume of off-gas released from the cell and in radiation so that again there is little possibility of reduction in heat loss in that direction.

In the operation of a reduction cell there is necessarily a balance between the heat generated in the cell and the heat loss from the cell. However considerable progress has been made in improving the efficiency of electrolytic reduction cells as measured in terms of rate of production of metal in relation to the electrical energy input to the cell. This is particularly so in cells designed to operate with low metal levels or drained cathodes. As the efficiency of the cell is improved in these terms by measures, such as a reduction of the anode/cathode distance, the voltage across the cell is somewhat reduced and the heat generated in the cell in overcoming the resistance of the molten electrolyte is reduced. In consequence the heat balance is disturbed and it becomes necessary to reduce the heat loss from the cell in order to avoid undesirable cooling of the electrolyte.

As already indicated one route presenting an opportunity of achieving a significant reduction in heat loss is to improve the insulation of the side walls. This involves either increase of the thickness of the insulation or employing an insulation of superior properties. A reduction of the heat loss through the side walls has the effect of an increase in temperature at the wall/electrolyte interface and eventually the elimination of the protective layer of solidified electrolyte. In a cell with carbon walls, the disappearance of the solidified electrolyte has a twofold disadvantage in that (a) it exposes the carbon lining to erosion by molten electrolyte (b) it establishes a current leakage path for the cathode current with attendant loss in efficiency.

It has also been proposed to line cells with other refractory materials which are resistant to attack by molten aluminium, such as alumina and alumina-cryolite mixtures. But all such materials are quite rapidly attacked by the cell electrolyte. So cell walls made of such material need to be protected from the molten electrolyte, either by means of a layer of solidified electrolyte or by some other means.

It is an object of the invention to overcome these difficulties and to provide an electrolytic reduction cell in which there is a substantial reduction in the heat loss through the side walls of the cell. In a cell constructed in accordance with the invention the heat loss from the cell through the portion of the cell wall in contact with the electrolyte is such that the formation of a solidified electrolyte layer at the cell wall will not take place so long as the electrolyte is maintained at an ordinary temperature of about 960° C.

The flow of current from the anodes to cathodically connected walls is particularly undesirable because the essentially horizontal currents react with the electromagnetic fields associated with the carriers of the electrical currents (cathode collector bars, bus bars etc.) and thus lead to magnetohydrodynamic disturbances in the electrolyte.

To overcome these difficulties there is provided, in accordance with the invention, an electrolytic reduction cell for the production of aluminium having a floor and side walls constructed of material resistant to attack by molten aluminium, the side walls being lined at least in part with ceramic material resistant to attack by the cell electrolyte and by molten aluminium, and being provided with thermal insulation to an extent such that a layer of solidified electrolyte is not present thereon during normal operation of the cell, the cell having a cathode current collection system arranged in such a manner that the horizontal lateral currents in the cathode are insignificant compared with the vertical current.

The preferred ceramic materials are borides, nitrides, oxynitrides etc., one suitable material being titanium diboride, either as fabricated bodies or as coatings on other materials such as alumina, silicon carbide etc. Such ceramic materials are extremely resistant to attack by the fluoride electrolyte and the metal of the reduction cell. They may however also be both thermally and electrically conductive and in such cases must be considered in terms of possessing metallike characteristics rather than in terms of ceramics, which are normally both thermal and electrical insulators. Where electrolyte-resistant borides are coated onto silicon carbide, the composite material is of advantageously low thermal and electrical conductivity.

Thus in a structure in which the side walls of the cell are lined with an electrically conductive diboride material it is important that the cathode structure should be arranged so that the proportion of the cathode current entering through the side walls is very small indeed. Preferably, the horizontal lateral currents in the cell (in a molten metal pad and/or in a conductive floor) should amount to not more than 1% of the vertical current passing through the floor of the cell. In a conventional electrolytic reduction cell the cathode current collectors are straight rods in electrical contact with the carbon floor blocks. It is found that there is a strong tendency for a large proportion of the current to flow laterally in the molten metal from the centre of the cell and exiting to the collectors through the carbon at a relatively narrow band adjacent the side walls. An even greater lateral current flow would take place via the carbon lining to the collectors in the absence of the normal layer of solidified electrolyte. However special collector bar arrangements are known which result in an essentially vertical current flow from the overhead anodes downwardly through the molten metal pool to collector bars embedded in the carbon floor blocks. One such system is described in British Patent Publication No. 2,008,617, in which the cell has a carbon floor which constitutes the cathode and the cathode current collection system comprises a plurality of current collector bars located in unitary form or in separate sections in the underside of the cell floor, there being provided a plurality of connector bars for each collector bar and each connector bar being connected at a point intermediate the ends of the collector bar or collector bar section. By using such a collector bar system it is possible to avoid substantial current flow in the metal to the outer edge of the carbon bottom block which is free of solidified electrolyte.

It has already been proposed in U.S. Pat. No. 3,256,173 to eliminate the layer of solidified electrolyte at the side walls because of the possibility that this will vary in thickness during cell operation and consequently upset the efficiency of the cell. It was proposed to achieve that result by lining the side walls of the cell with a mouldable composition of powdered silicon carbide, powdered coke and pitch. The coke and pitch form a matrix in which the silicon carbide, which typically forms 70–80% of the composition, is embedded. The resultant mix was stated to have an electrical conductivity and thermal conductivity 5–15 times less than that of a conventional carbon lining and to be resistant to attack by the bath electrolyte.

We have found that silicon carbide particles proposed by the patent are substantially less resistant to attack by molten electrolyte and molten aluminium than are the diboride ceramics employed in the present invention. Any silicon carbide particles, displaced from the side wall by attack of the carbon matrix by the electrolyte, will form a constant source of silicon for attack by the product metal. That would result in silicon contamination of such metal and its downgrading as a commercial product. The patent does not address the further problems which arise when an electrically conductive ceramic material is used to line the side walls.

It has also been proposed in U.S. Pat. No. 3,856,650 to carry out the electrolytic production of aluminium in a cell in which the interior surface of the cell is in contact with an electrically conductive ceramic, applied to the surface by a spraying technique to achieve a very thin layer of ceramic, which is resistant to attack by the electrolyte. It appears that the object of that invention is to reduce the thickness of the cell wall so as to achieve the largest possible cell volume within the outer shell wall. Primarily the object is achieved by using a steel cell wall, protected by a sprayed-on ceramic layer of a thickness of 0.5–1 mm. The ceramic is required to be electrically conducting and resistant to attack by fluoride electrolyte and molten aluminium: titanium diboride is the preferred ceramic material.

The cell illustrated, having a cell wall of steel coated with titanium diboride, has cathode current collectors connected directly to the floor of the pot. In the case of cells formed of carbon, the patent teaches that the cathode current collectors would be embedded in the vessel wall in the conventional manner. Such an arrangement, with electrically conducting side walls and no protective layer of solidified electrolyte, would give rise to unacceptably large horizontal lateral currents, which could disturb the layers of electrolyte and metal in the cell.

The system of the U.S. Pat. No. 3,856,650 of applying an adherent ceramic coating to steel would be hazardous because any local detachment or cracking of the coating would result in very rapid attack of the cell wall by molten aluminium deposited at the active cathode surface of such wall. Such attack could lead to rapid penetration of the steel cell wall with consequent disastrous failure of the cell. There is a high possibility of such cracking or displacement as a result of the higher coefficient of expansion of steel.

By contrast, in the system of the present invention, the walls and floor of the cell are constructed of material resistant to attack by molten aluminium; and the cell walls are preferably formed of separate titanium diboride or equivalent tiles or panels. These may be embedded in a conventional carbon material, so that local failure of the ceramic cannot lead to disastrous failure of the cell. Alternatively, and preferably, they may be embedded in alumina or welded to a composite ceramic base material comprising Group IVb, Vb or VIb refractory metal carbides, borides or nitrides with an Al-containing phase such as alumina.

In a preferred arrangement in accordance with the invention the bottom edges of the ceramic tiles are fixed for structural stability, but they are free to expand or contract in the vertical direction without undue stress being developed. Conventional carbon cathode materials are subject to expansion when exposed to molten cryolite due to sodium pick-up. Where the bottoms of the ceramic tiles are embedded in conventional carbon materials, differential expansion may cause the tiles. to crack. Graphitized carbon materials are much less subject to attack by cryolite and are preferable to ordinary carbon.

At approximately the upper level of the electrolyte it is desired to develop solidified electrolyte in a very restricted zone adjacent the top edge of the side wall to protect the ceramic material against aerial oxidation. This result may conveniently be achieved by capping the side wall with carbon and omitting or reducing the insulation immmediately behind it. Alternatively, development of the desired layer of solidified electrolyte can be controlled in a more positive way by positioning a steel pipe adjacent the top edge of the side wall. Cool air can be circulated through the pipe in an amount chosen to control the temperature gradient and freezing of electrolyte.

The highly insulated side wall system of the present invention is very conveniently employed in conjunction with any system for damping out or preventing movement or distortion of the pool of molten metal in the bottom of the cell with the consequent possibility of reduction of the anode-cathode distance of the cell. The floor of the cell may in some instances also be lined with $TiB_2$ ceramic tiles, although in may cases a conventional carbon floor will be satisfactory, provided that an appropriate current collection system is provided.

The thickness of the ceramic tiles of the cell side walls would usually be not less than 0.25 cm, preferably at least 0.5 cm, by contrast with the sprayed-on layer of ceramic particles having a thickness about 0.5 mm, described in U.S. Pat. No. 3,856,650.

The accompanying drawing is a sectional side elevation of an electrolytic reduction cell according to the invention.

Within a steel shell 1 is a thermally and electrically insulating lining 2 of alumina blocks. The cathode of the cell is constituted by a pad 3 of molten aluminium supported on a bed 4 of carbon blocks. Overlying the molten metal pad 3 is a layer 5 of molten electrolyte, in which anodes 6 are suspended.

Ceramic tiles 7 constitute the side walls of the cell. These are fixed at their lower edges in slots machined in the carbon blocks 4, their upper edges being free. Behind each tile 7 adjacent its upper edge there is a pipe 8 for coolant. A solid crust 9 has formed on the top of the electrolyte layer 5. Because of the cooling pipe 8, this crust surrounds the top edges of the tiles 7 and protects them from atmospheric attack.

A current collector bar 10 is shown in four sections between the carbon bed 4 and the alumina lining 2. Each section is connected at a point intermediate its ends to a connector bar 11 which extends through the shell 1. The electrical power supply between the anodes 6 and the connector bars 11 outside the cell is not shown.

In use, the electrolyte 5 is maintained at a temperature of around 960° C. The thermal insulation 2 behind the ceramic tiles 7 is so good that a layer of frozen electrolyte does not form on the tiles, except at their upper edges. The current collection system 10, 11 ensures that the current passes substantially vertically through the carbon bed 4. Only an insignificant fraction of the current appears at the side walls. No significant amount of current flows from the anodes 6 to the side walls 7.

I claim:

1. An electroytic reduction cell for the production of aluminium by reduction of alumina in a molten fluoride electrolyte having floor and side walls constructed of material resistant to attack by molten aluminium, the side walls being lined at least in part with ceramic material selected from the class consisting of borides, nitrides and oxynitrides resistant to attack by the cell electrolyte and by molten aluminium, and being provided with thermal insulation to an extent such that a layer of solidified electrolyte is not present thereon during normal operation of the cell, the cell having a cathode current collection system arranged in such manner that the horizontal lateral currents in the cathode are insignificant compared with the vertical current, said ceramic material being used in the form of tiles or panels at least 0.5 cm thick.

2. A cell as claimed in claim 1, wherein the ceramic material is titanium diboride.

3. A cell as claimed in claim 1, wherein the tiles or panels are fixed at their bottom edges but are free to expand or contract in a vertical direction.

4. A cell as claimed in claim 3, wherein the tiles or panels are fixed by being embedded in a graphitized carbon material or alumina or welded to a composite ceramic base material comprising Group IVb, Vb or VIb refractory metal carbides, borides or nitrides with an Al-containing phase.

5. A cell as claimed in claim 1, wherein the cell has a carbon floor which contitutes the cathode and the cathode current collection system comprises a plurality of current collector bars located in unitary form or in separate sections in the underside of the cell floor, there being provided a plurality of connector bars for each collector bar and each connector bar being connected at a point intermediate the ends of the collector bar or collector bar section.

6. A cell as claimed in claim 1, wherein a cooling pipe is positioned adjacent the top edge of the side wall to permit the formation of solid electrolyte in a restricted zone during operation of the cell so as to protect the ceramic material against aerial oxidation.

7. A cell as claimed in claim 1, wherein means are provided for damping out or preventing movement or distortion of any pool of molten metal in the bottom of the cell.

* * * * *